US009753394B2

(12) United States Patent
Nakayama et al.

(10) Patent No.: US 9,753,394 B2
(45) Date of Patent: Sep. 5, 2017

(54) IMAGE FORMING DEVICE, CONTROL METHOD FOR IMAGE FORMING DEVICE, AND CONTROL PROGRAM FOR IMAGE FORMING DEVICE

(71) Applicant: Konica Minolta, Inc., Chiyoda-ku, Tokyo (JP)

(72) Inventors: Kanji Nakayama, Toyokawa (JP); Shinichi Yoshimoto, Tokyo (JP); Junji Kanda, Toyota (JP); Yasuyuki Inada, Toyohashi (JP); Yuusuke Mandai, Kyoto (JP); Yu Mukobayashi, Nagoya (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/159,195

(22) Filed: May 19, 2016

(65) Prior Publication Data

US 2016/0363882 A1 Dec. 15, 2016

(30) Foreign Application Priority Data

Jun. 9, 2015 (JP) ..... 2015-116952

(51) Int. Cl.

| | |
|---|---|
| ***G03G 15/02*** | (2006.01) |
| ***G03G 15/06*** | (2006.01) |
| ***G03G 21/14*** | (2006.01) |

(52) U.S. Cl.

CPC ..... *G03G 15/0266* (2013.01); *G03G 15/065* (2013.01); *G03G 21/14* (2013.01)

(58) Field of Classification Search

CPC ... G03G 15/065; G03G 15/0266; G03G 21/14
See application file for complete search history.

(56) References Cited

U.S. PATENT DOCUMENTS 5,221,944 A * 6/1993 Yoda et al. ..... G03G 15/0163 399/233
2010/0135685 A1* 6/2010 Chang et al. ..... G03G 15/065 399/55

(Continued)

FOREIGN PATENT DOCUMENTS

JP 54-012843 A 1/1979
JP 03-200992 9/1991

(Continued)

OTHER PUBLICATIONS

Notice of Reasons for Rejection issued in corresponding Japanese Patent Application No. 2015-116952; dated May 2, 2017, with English Translation (15 pages).

*Primary Examiner* — David M Gray
*Assistant Examiner* — Carla Therrien
(74) *Attorney, Agent, or Firm* — Buchanan Ingersoll & Rooney PC

(57) ABSTRACT

An image forming device includes: a charging unit configured to apply charging bias voltage to a charging member and charge a surface of an image carrying body; an exposure unit configured to expose the surface of the image carrying body, and form an electrostatic latent image; a developing unit configured to apply developing bias voltage to a developer carrying body, and develop the electrostatic latent image; and a control unit configured to control timing to start applying the developing bias voltage relative to timing to start applying the charging bias voltage, wherein the control unit performs control such that the larger an absolute value of the charging bias voltage is, the shorter an interval from timing to start applying the charging bias voltage to timing to start applying the developing bias voltage becomes, and such that the smaller the absolute value is, the longer the interval becomes.

11 Claims, 12 Drawing Sheets

(56) References Cited

U.S. PATENT DOCUMENTS

| | | | | |
|---|---|---|---|---|
| 2012/0121307 | A1* | 5/2012 | Shiiya et al. ..... | G03G 15/10<br>399/348 |
| 2015/0378276 | A1* | 12/2015 | Hironaka et al. .. | G03G 15/5008<br>399/55 |

FOREIGN PATENT DOCUMENTS

| | | |
|---|---|---|
| JP | 08-314236 | 5/1995 |
| JP | 2001-265193 A | 9/2001 |
| JP | 2009-020397 | 7/2007 |

* cited by examiner

IMAGE FORMING DEVICE, CONTROL METHOD FOR IMAGE FORMING DEVICE, AND CONTROL PROGRAM FOR IMAGE FORMING DEVICE

The entire disclosure of Japanese Patent Application No. 2015-116952 filed on Jun. 9, 2015 including description, claims, drawings, and abstract are incorporated herein by reference in its entirety.

BACKGROUND OF THE INVENTION

Field of the Invention

The present invention relates to an image forming device, a control method for the image forming device, and a control program for the image forming device, and particularly relates to an image forming device that forms an image on a paper by electrophotography, a control method for the image forming device, and a control program for the image forming device.

Description of the Related Art

An electrophotographic image forming device is widely used for such purposes as a multi-function peripheral (MFP) having a scanner function, a facsimile function, a copy function, a function as a printer, a data communication function, and a server function, a facsimile machine, a copy machine, and a printer.

In the electrophotographic image forming device, a two-component development system is widely used. In the two-component development system, toner and developer including a magnetic carrier is used. In the case where image forming is performed by the two-component development system, malfunction may occur when the toner or the carrier grossly adheres to a portion immediately before an image area on an image carrying body. To avoid such malfunction, normally, timing to start applying charging bias voltage and timing to start applying developing bias voltage are set.

Typical examples of such malfunction caused by the carrier adhering to the portion immediately before the image area on the image carrying body (hereinafter may be referred to as carrier adhesion) may be as follows. More specifically, a flaw may be made on a cleaning blade when the carrier remaining on the image carrying body is scraped from the image carrying body by the cleaning blade. When the flaw is made on the cleaning blade, cleaning failure may occur on the image carrying body later due to the portion having the flaw, and a black stripe may appear on a formed image.

Furthermore, in a transfer system in which a transfer member like a transfer roller contacts the image carrying body, a carrier adhering to the image carrying body may adhere to the transfer member. Carrier adhesion to the transfer member may cause transfer failure at the time of transferring a toner image to a transfer material (such as paper and an intermediate transfer belt) from the image carrying body next time. For example, an abnormal state such as a white spot appearing on a formed image may be caused.

On the other hand, typical examples of such malfunctions caused by toner adhering to the portion immediately before the image area on the image carrying body (hereinafter may be referred to as toner adhesion) are as follows. More specifically, in the case of performing transfer by a contact transfer system, the toner on the image carrying body may directly adhere on the transfer member. When the toner adheres to the transfer member, an abnormality such as marking back on a transfer material may be caused at the time of transferring a toner image to the transfer material next time.

Particularly, when a transfer roller made of a foamed sponge having an uneven surface is used as the transfer member, the problem of toner adhesion is apparent. In this case, the toner adhering to the transfer roller enters a recessed portion of the transfer roller. The toner having entered the recessed portion adheres to a surface of the transfer material contacting the transfer roller when the transfer material passes. Since the transfer roller contacts the image carrying body in a pressurized manner, a diameter of the transfer roller in a portion contacting the image carrying body is different from a diameter thereof in a portion not contacting the image carrying body. On the surface of the transfer roller contacting the image carrying body, a shape of the recessed portion is changed and the toner is discharged from the recessed portion This may cause the discharged toner to adhere to a back surface of the transfer material, and a stain may be made with the toner.

Charge of the carrier has a sign opposite to a sign of charge of the toner; one is positive and the other is negative. Therefore, prevention of carrier adhesion and prevention of toner adhesion by controlling a potential difference between the developer carrying body and the image carrying body mutually have a trade-off relationship. The malfunction caused by carrier adhesion gives more damage on an image forming device. Therefore, generally, the potential difference between the developer carrying body and the image carrying body is controlled so as to prevent carrier adhesion completely first and then suppress toner adhesion as much as possible.

Meanwhile, JP 54-12843 A discloses an electrophotographic device in which a start time of development in a developing device is delayed until a non-charged portion of a photoreceptor reaches a developing position. This prevents wasteful toner consumption.

JP 2001-265193 A discloses an image forming device in which timing to start applying charging bias voltage and developing bias voltage is changed in accordance with a detection value of a toner concentration detection sensor. The toner concentration detection sensor is a sensor to detect a ratio between toner and carriers inside the developing device.

In an image forming device described above, an occurring state of carrier adhesion is varied by a charging state on a surface of an image carrying body. Therefore, when design is made so as not to cause carrier adhesion under any kinds of conditions, there may be a problem that a toner adhesion amount is increased.

The occurring states of carrier adhesion and toner adhesion are varied by a charging range on the surface of the image carrying body. Normally, potential on the surface of the image carrying body is set so as to keep a constant potential difference relative to bias voltage applied to a developing roller. Therefore, the occurring states of carrier adhesion and toner adhesion are substantially the same between cases where the potential on the surface of the image carrying body has a large absolute value and a small absolute value. On the other hand, comparing a case of having a wide charging range on the surface of the image carrying body with a case of not having such a wide charging range, an area charged when application of charging bias voltage is started reaches a developing nip portion in early timing. Therefore, in the case of having the wide charging range, carrier adhesion may be caused unless application of the developing bias voltage is started in earlier timing than the case of not having such a wide charging range. In contrast, when the timing to start applying the developing bias voltage is thus set early conform to the case of having the wide charging range, there may be a problem in which a toner consumption amount is increased in the case of having a narrow charging range.

These problems are apparent especially in an image forming device in which the surface of the image carrying body is charged by a discharging phenomenon, such as a roller charging system in which direct current bias voltage (DC bias voltage) is applied as the charging bias voltage. The reason is that a range to be charged is largely varied by the way of discharging. More specifically, when design is made such that application of the developing bias voltage is started early conforming to a case of performing relatively intense discharge in order to prevent carrier adhesion, a toner consumption amount may be increased in the case of performing relatively weak discharge.

SUMMARY OF THE INVENTION

The present invention has been made to solve the above-described problems, and an object thereof is to provide an image forming device, a control method for the image forming device, and a control program for the image forming device, which can prevent carrier adhesion to the image carrying body while suppressing toner consumption.

To achieve the abovementioned object, according to an aspect, an image forming device reflecting one aspect of the present invention comprises: a charging unit configured to apply charging bias voltage to a charging member and charge a surface of an image carrying body; an exposure unit configured to expose the surface of the image carrying body charged by the charging unit to attenuate potential, and form an electrostatic latent image on the image carrying body; a developing unit of a two-component development system configured to apply, to a developer carrying body, developing bias voltage having homopolarity with polarity of the charging bias voltage, and develop the electrostatic latent image; and a control unit configured to control timing to start applying the developing bias voltage relative to timing to start applying the charging bias voltage in accordance with a value of the charging bias voltage applied during image forming, wherein the control unit performs control such that the larger an absolute value of the charging bias voltage is, the shorter an interval from timing to start applying the charging bias voltage to timing to start applying the developing bias voltage becomes, and performs control such that the smaller the absolute value of the charging bias voltage is, the longer the interval becomes.

Preferably an upper limit value of the interval is preliminarily set, and the control unit preferably performs control such that the interval becomes the upper limit value when the absolute value of the charging bias voltage is smaller than a value corresponding to the upper limit value.

The image forming device preferably further includes a target value determining unit configured to determine a target value of surface potential of the image carrying body during image forming based on a target value of the developing bias voltage applied during image forming, wherein the charging unit preferably determines the charging bias voltage based on the target value determined by the target value determining unit.

The charging unit preferably charges the surface of the image carrying body by a roller charging system.

The control unit preferably performs control such that the larger a maximum absolute value of the charging bias voltage during image forming is, the shorter the interval becomes, and the control unit performs control such that the smaller the maximum absolute value of the charging bias voltage during image forming is, the longer the interval becomes.

The charging bias voltage is preferably direct current bias voltage.

The developing unit preferably applies the developing bias voltage in a manner increasing the absolute value of the developing bias voltage stepwisely, and a value of the developing bias voltage to be applied in a first step after starting applying the developing bias voltage is preferably a value offset by a predetermined amount relative to a target value of surface potential of the image carrying body during image forming.

To achieve the abovementioned object, according to an aspect, a control method for an image forming device comprising: a charging unit configured to apply charging bias voltage to a charging member and charge a surface of an image carrying body; an exposure unit configured to expose the surface of the image carrying body charged by the charging unit to attenuate potential, and form an electrostatic latent image on the image carrying body; and a developing unit of a two-component development system configured to apply, to a developer carrying body, developing bias voltage having homopolarity with polarity of the charging bias voltage, and develop the electrostatic latent image, reflecting one aspect of the present invention comprises: a determining step of determining a value of the charging bias voltage to be applied during image forming; and a controlling step of controlling timing to start applying the developing bias voltage relative to timing to start applying the charging bias voltage in accordance with the value of the charging bias voltage determined in the determining step, wherein, in the controlling step, control is performed such that the larger an absolute value of the charging bias voltage is, the shorter an interval from timing to start applying the charging bias voltage to timing to start applying the developing bias voltage becomes, and control is performed such that the smaller the absolute value of the charging bias voltage is, the longer the interval becomes.

To achieve the abovementioned object, according to an aspect, a non-transitory recording medium storing a computer readable control program for an image forming device comprising: a charging unit configured to apply charging bias voltage to a charging member and charge a surface of an image carrying body; an exposure unit configured to expose the surface of the image carrying body charged by the charging unit to attenuate potential, and form an electrostatic latent image on the image carrying body; and a developing unit of a two-component development system configured to apply, to a developer carrying body, developing bias voltage having homopolarity with polarity of the charging bias voltage, and develop the electrostatic latent image, reflecting one aspect of the present invention causes a computer to execute: a determining step of determining a value of the charging bias voltage applied during image forming; and a controlling step of controlling timing to start applying the developing bias voltage relative to timing to start applying the charging bias voltage in accordance with the value of the charging bias voltage determined in the determining step, wherein, in the controlling step, control is performed such that the larger an absolute value of the charging bias voltage is, the shorter an interval from timing to start applying the charging bias voltage to timing to start applying the developing bias voltage becomes, and control is performed such that the smaller the absolute value of the charging bias voltage is, the longer the interval becomes.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
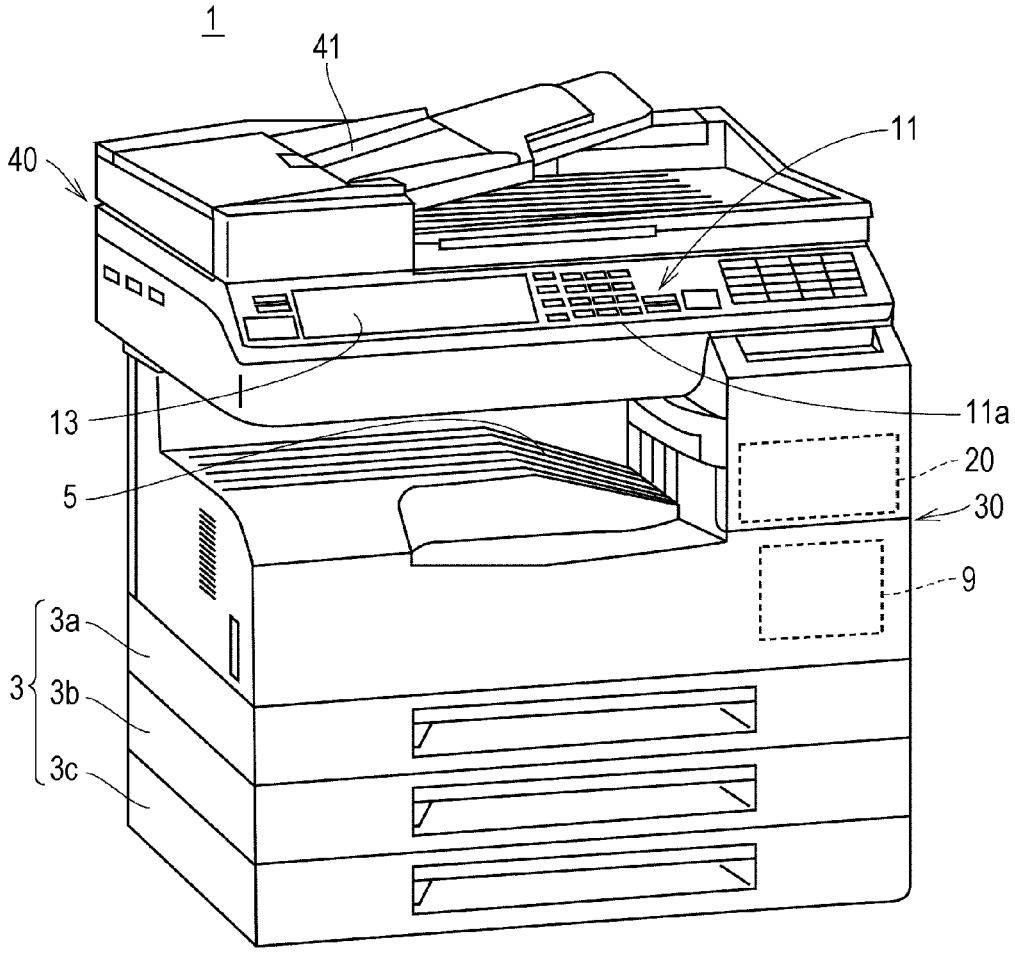
FIG. 1 is a perspective view illustrating an image forming device according to an embodiment of the present invention.

Hereinafter, an image forming device according to an embodiment of the present invention will be described with reference to the drawings. However, the scope of the invention is not limited to the illustrated examples.

The image forming device is a multi function peripheral (MSP) having a scanner function, a copy function, a function as a printer, a facsimile function, a data communication function, and a sever function. According to the scanner function, an image of a document set is read and stored in a hard disk drive (HDD) and the like. According to the copy function, the read image is further printed on a paper and the like (image forming). According to the function as the printer, when a print command is received from an external terminal such as a PC, printing is performed on the paper based on the command. According to the facsimile function, facsimile data is received from an external facsimile machine and stored in an HDD and the like. According to the data communication function, data is exchanged with an external device connected thereto. According to the server function, data stored in the HDD can be shared by a plurality of users.

The image forming device forms an image by electrophotography of a two-component development system. The image forming device exposes an image carrying body charged by a charging roller, for example. Then, the image forming device develops a formed electrostatic latent image by using a developer carrying body of a developing device. The image carrying body is charged by applying charging bias voltage to the charging roller. At the time of development, developing bias voltage having homopolarity with the charging bias voltage is applied to the developer carrying body.

In order to prevent carrier adhesion to the image carrying body while suppressing toner consumption, it is important to keep an appropriate potential difference between a surface of the image carrying body and the developer carrying body. Also, a relative relation of application timing between the charging bias voltage and the developing bias voltage is important. In the present embodiment, the timing to start applying the developing bias voltage to the developer carrying body relative to the timing to start applying the charging bias voltage is controlled in accordance with a value of the charging bias voltage applied to the charging roller during image forming (while printing).

More specifically, control is performed such that the larger the absolute value of the charging bias voltage is, the shorter the interval from the timing to start applying charging bias voltage to the timing to start applying the developing bias voltage becomes. In other words, control is performed such that the timing to start applying the developing bias voltage relative to the timing to start applying the charging bias voltage becomes early (or such that the timing to start applying the charging bias voltage relative to the timing to start applying the developing bias voltage becomes late).

Furthermore, control is performed such that the smaller the absolute value of the charging bias voltage is, the longer the interval from the timing to start applying charging bias voltage to the timing to start applying the developing bias voltage becomes. In other words, control is performed such that the timing to start applying the developing bias voltage relative to the timing to start applying the charging bias voltage becomes late (or such that the timing to start applying the charging bias voltage relative to the timing to start applying the developing bias voltage becomes early).

Meanwhile, normally, there are many cases where the developing bias voltage before start printing is 0 V relative to a common ground (ground potential) of the image carrying body. However, there may be a case where extremely small output (output that does not contribute to toner movement, for example, output less than 50 V) or the bias voltage having heteropolarity with the charging bias voltage is output for a purpose other than development. In the present embodiment, such a state in which the extremely small voltage or the bias voltage having heteropolarity is output is not called a state of "applying" the developing bias voltage. In the present embodiment, the state of outputting the bias voltage that has homopolarity with the charging bias voltage and has relatively high voltage to move the toner is called the state of "applying" the developing bias voltage. Furthermore, in the present embodiment, a case of starting to output the developing bias voltage from a state of having the output of 0 V or merely almost 0 V or from a state of outputting the bias voltage having heteropolarity is called "start applying the developing bias voltage".

Embodiment

FIG. 1 is a perspective view illustrating an image forming device according to an embodiment of the present invention.

[Structure of Image Forming Device 1]

As illustrated in FIG. 1, an image forming device 1 includes a paper feeding cassette 3, a paper discharging tray 5, a power supply unit 9, an operating unit 11, a controller (an exemplary control unit) 20, a printing unit 30, and a scanning unit 40. The controller 20 includes a CPU 21 and the like as described later (refer to FIG. 4). The controller 20 and the printing unit 30 are disposed inside a housing of the image forming device 1.

The image forming device 1 includes three paper feeding cassettes 3 (paper feeding cassettes 3*a*, 3*b*, 3*c*). In the respective paper feeding cassettes 3, for example, papers having sizes different from each other are preloaded (such as B5 size, A4 size, and A3 size). The paper feeding cassettes 3 are disposed at a lower portion of the image forming device 1 in a manner insertable and ejectable relative to the housing of the image forming device 1. The papers preloaded in the respective paper feeding cassettes 3 are supplied one by one from the paper feeding cassettes 3 at the time of printing, and fed to the printing unit 30. Note that the number of the paper feeding cassettes 3 is not limited to three, and may be more or may be less than that.

The paper discharging tray 5 is disposed above a region where the printing unit 30 is housed and also under a portion where the scanning unit 40 is disposed in the housing of the image forming device 1. A paper formed with an image by the printing unit 30 is discharged from the inside of the housing to the paper discharging tray 5.

The power supply unit 9 is provided inside the housing of the image forming device 1. The power supply unit 9 is connected to a commercial power supply, and supplies power to the controller 20, the printing unit 30, and the like based on the commercial power supply.

The operating unit 11 is disposed on an upper front surface side of the image forming device 1. In the operating unit 11, a plurality of operation buttons 11*a* that can be pushed and operated by a user is arranged. Furthermore, a display panel 13 is arranged in the operating unit 11. The display panel 13 is, for example, a liquid crystal display (LCD) including a touch panel. The display panel 13 displays a guide screen for the user, displays the operation buttons, and receives touch operation from the user. The display panel 13 performs display under the control of the CPU 21. When the operation button 11*a* or the display panel 13 is operated by the user, the operating unit 11 transmits an operation signal or a predetermined command to the CPU 21 in accordance with the user's operation. More specifically, the user can make the image forming device 1 execute various kinds of operation by operating the operating unit 11.

The printing unit 30 generally includes a toner image forming unit 300, a paper conveying unit (not illustrated), and a fixing device (not illustrated). The printing unit 30 forms an image on a paper by electrophotography. The printing unit 30 combines images of four colors by a so-called tandem system, and has a configuration capable of forming a color image on the paper. The structure of the toner image forming unit 300 will be described later.

The paper conveying unit is formed of a feeding roller, a conveying roller, a motor to drive these rollers, and the like. The paper conveying unit supplies a paper from the paper feeding cassette 3, and conveys the paper inside the housing of the image forming device 1. Furthermore, the paper conveying unit discharges a paper formed with an image to the paper discharging tray 5 or the like from the housing of the image forming device 1.

The fixing device includes a heating roller and a pressure roller. The fixing device conveys a paper formed with a toner image while nipping the paper between the heating roller and the pressure roller, and applies heat and pressure to the paper. Consequently, the fixing device melts the toner adhering to the paper and fixes the same on the paper, thereby forming an image on the paper.

The scanning unit 40 is disposed at an upper portion of the housing of the image forming device 1. The scanning unit 40 includes an auto document feeder (ADF) 41. The scanning unit 40 executes a scanner function described above. The scanning unit 40 scans, with a contact image sensor, a document placed on a transparent document table, and reads the same as image data. Furthermore, the scanning unit 40 sequentially introduces a plurality of documents set on a document tray by the ADF 41, and reads image data thereof with the contact image sensor.

Figure 2:
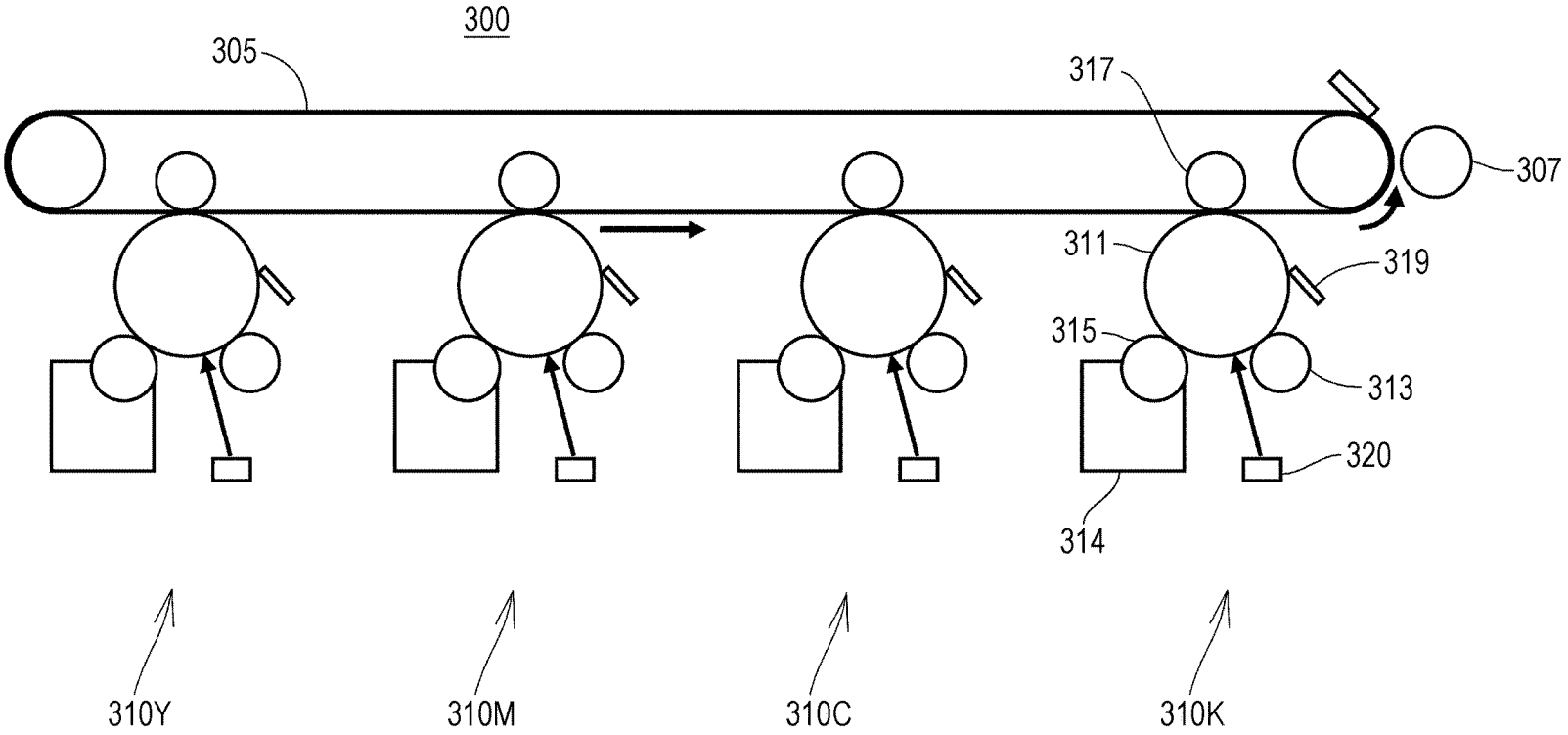
FIG. 2 is a side view illustrating a structure of a toner image forming unit of the image forming device.

FIG. 2 is a side view illustrating a structure of the toner image forming unit 300 of the image forming device 1.

As illustrated in FIG. 2, the toner image forming unit 300 includes an intermediate transfer belt 305, a transfer roller 307, four sets of print heads 310Y, 310M, 310C, 310K (hereinafter may be referred to as print head 310 without differentiating the respective ones), a laser scan unit (exemplary exposure unit) 320, and the like.

The intermediate transfer belt 305 is annular and suspended between two rollers. The intermediate transfer belt 305 moves rotationally in tandem with the paper conveying unit. The transfer roller 307 is arranged so as to face a portion of the intermediate transfer belt 305 contacting one of the rollers. The paper is conveyed while being nipped between the intermediate transfer belt 305 and the transfer roller 307.

Each of the print heads 310 includes a photoreceptor (exemplary image carrying body) 311, a charging roller (exemplary charging member, exemplary charging unit) 313, a developing device (exemplary developing unit) 314, a belt transfer roller 317, a cleaning blade 319, and the like. As the print heads 310, there are four print heads disposed to form images of respective colors including yellow (Y), magenta (M), cyan (C), and black (K). The four sets of print heads 310 are arranged in a manner aligned with each other so as to be located along the intermediate transfer belt 305. The laser scan unit 320 is disposed so as to scan the photoreceptor 311 of each of the print heads 310 with laser light. Meanwhile, the laser scan unit 320 may be provided per print head 310, or one laser scan unit 320 may scan the photoreceptors 311 of the respective print heads 310 with the laser light.

In the toner image forming unit 300, each of the laser scan units 320 forms an electrostatic latent image on the photoreceptor 311 of each of the print heads 310 based on image data in each color of YMCK. The developing device 314 develops the electrostatic latent image formed on each of the photoreceptors 311 by using the developing roller (exemplary developer carrying body) 315, and forms a toner image of one of the colors on each of the photoreceptors 311. Each of the photoreceptors 311 transfers the toner image to the intermediate transfer belt 305, and forms, on the intermediate transfer belt 305, a mirror image of the toner image to be formed on a paper (first transfer). After that, the toner image formed on the intermediate transfer belt 305 is transferred to the paper by the transfer roller 307, and the toner image is formed on the paper (second transfer).

Figure 3:
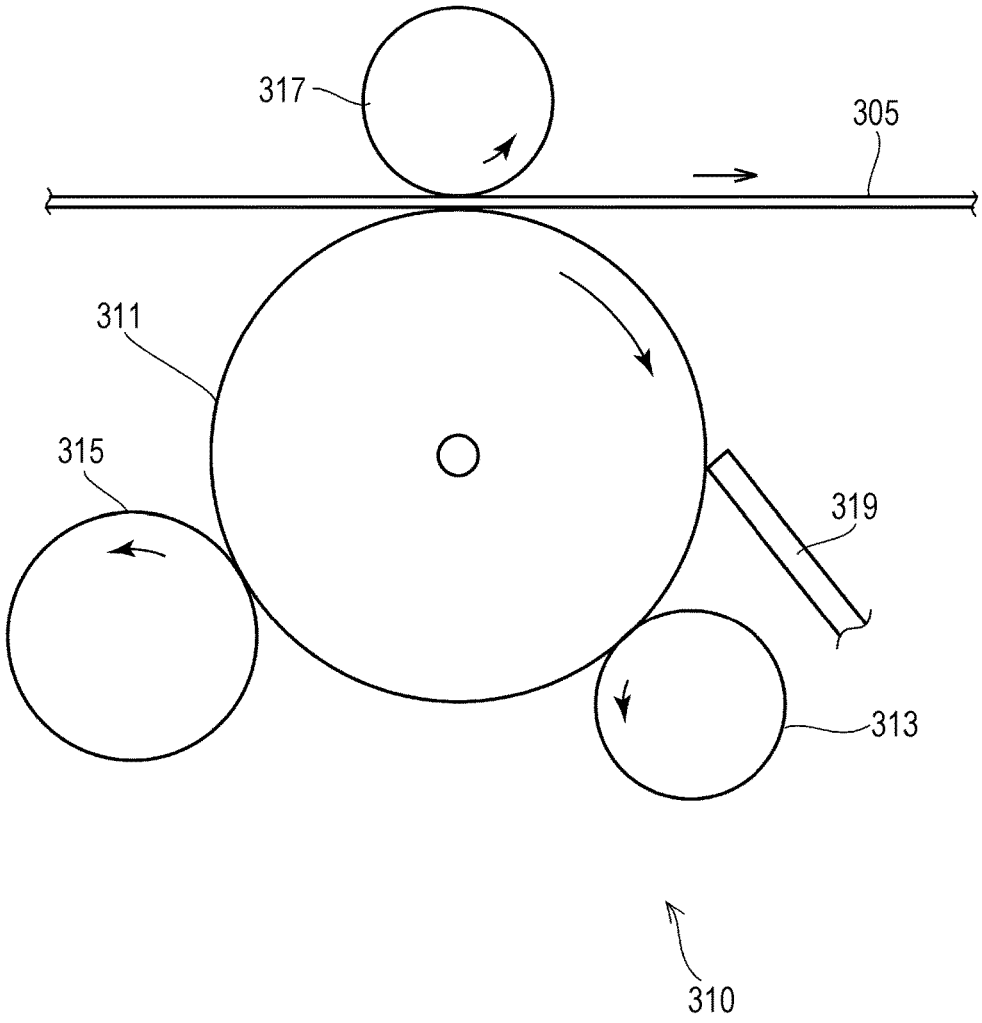
FIG. 3 is a side view illustrating a print head.

FIG. 3 is a side view illustrating the print head 310.

As illustrated in FIG. 3, each of the print heads 310 has a structure substantially the same as that in a general image forming device in the related art. More specifically, the photoreceptor 311 has a drum-like shape and includes an organic photo conductor/organic photoreceptor (OPC) in a barrel portion thereof. In the periphery of the photoreceptor 311, the charging roller 313, developing roller 315, belt transfer roller 317, and cleaning blade 319 are sequentially disposed in a rotation direction of the photoreceptor 311.

In each of the print heads 310, a surface of the photoreceptor 311 is charged by a roller charging system. More specifically, the charging roller 313 charges the surface of the photoreceptor 311 by applying high-voltage charging bias voltage between the charging roller 313 and the photoreceptor 311. The laser scan unit 320 irradiates, with laser light, a charged region out of the surface of the photoreceptor 311, and attenuates potential. An electrostatic latent image is thus formed on the surface of the photoreceptor 311.

In the present embodiment, the charging bias voltage is direct current bias voltage, but not limited thereto.

The developing device 314 causes the toner to adhere to the electrostatic latent image formed on the surface of the photoreceptor 311, and forms a toner image. In the present embodiment, the developing device 314 adopts the two-component development system. The developing device 314 applies developing bias voltage to the developing roller 315, and moves the toner existing on the developing roller 315 side to the photoreceptor 311 side, thereby developing the electrostatic latent image. The developing bias voltage is the bias voltage having homopolarity with the charging bias voltage.

The belt transfer roller 317 applies charge while nipping the intermediate transfer belt 305 with the photoreceptor 311, and transfers the toner image from the photoreceptor 311 onto the intermediate transfer belt 305. The cleaning blade 319 contacts the surface of the photoreceptor 311 and collects the toner remaining on the surface of the photoreceptor 311.

Figure 4:
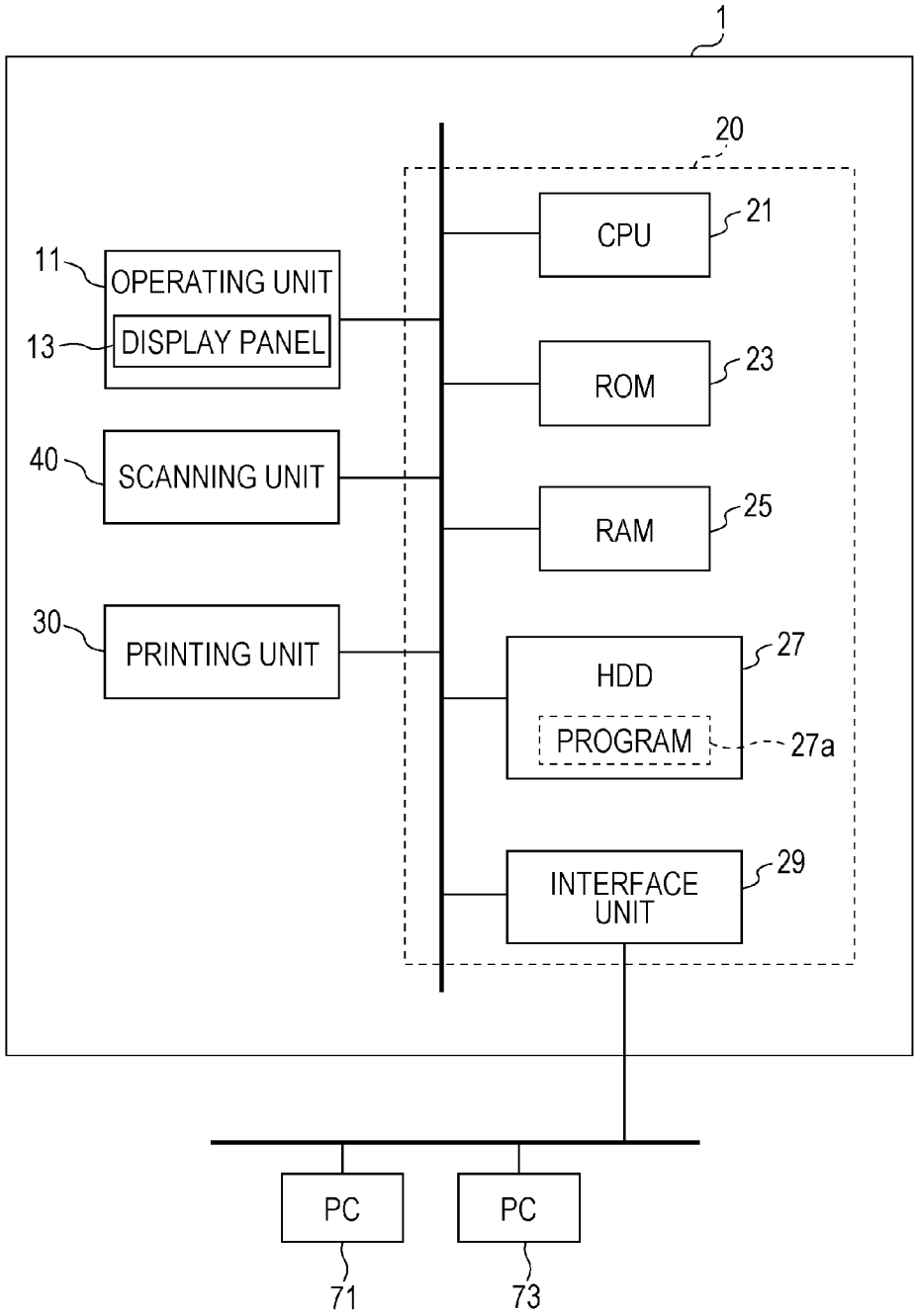
FIG. 4 is a block diagram illustrating a hardware configuration of the image forming device.

FIG. 4 is a block diagram illustrating a hardware configuration of the image forming device 1.

As illustrated in FIG. 4, the controller 20 includes the CPU 21, a ROM 23, a RAM 25, a HDD 27, and an interface unit 29. The controller 20 is connected to a system bus together with the operating unit 11, the printing unit 30, the scanning unit 40, and the like. With this configuration, the controller 20 and the respective units of the image forming device 1 are connected in a manner capable of exchanging signals.

The HDD 27 stores job data transmitted from the outside via the interface unit 29, image data read by the scanning unit 40, and the like. Furthermore, the HDD 27 stores setting information for the image forming device 1, a control program (program) 27*a* to perform various kinds of operation in the image forming device 1, and the like. The HDD 27 can store a plurality of jobs transmitted from one client PC, a plurality of client PCs, and the like.

The interface unit 29 is formed by, for example, combining a hardware portion such as a network interface card (NIC) with a software portion to perform communication by a predetermined communication protocol. The interface unit 29 connects the image forming device 1 to an external network such as a LAN. With this configuration, the image forming device 1 can communicate with an external device such as a client PC connected to the external network. In FIG. 4, the image forming device 1 is connected to an external network connected to, for example, a PC 71 and a PC 73. The image forming device 1 can receive a print job from the PCs 71 and 73. Furthermore, the image forming device 1 can transmit image data read by the scanning unit 40 to the PC 71, and also can transmit the same by an e-mail via a mail server or the like. Meanwhile, the interface unit 29 may also have a configuration connectable to an external network by wireless communication. Furthermore, the interface unit 29 may also be a universal serial bus (USB) interface, for example. In this case, the interface unit 29 enables communication between an external device and the image forming device 1 connected via a communication cable.

The CPU 21 controls various kinds of operation of the image forming device 1 by executing the control program 27*a* stored in the ROM 23, RAM 25, HDD 27, or the like. When an operation signal is transmitted from the operating unit 11 or when an operation command is transmitted from the PC 71 and the like, the CPU 21 executes a predetermined control program 27*a* in accordance therewith. Consequently, a predetermined function of the image forming device 1 is executed in accordance with operation at the operating unit 11 by a user.

The ROM 23 is, for example, a flash ROM (flash memory). In the ROM 23, data used to execute operation of the image forming device 1 is stored. In the ROM 23, same as the HDD 27, various kinds of control programs, function setting data of the image forming device 1, and the like may also be stored. The CPU 21 reads data from the ROM 23 and writes data in the ROM 23 by performing predetermined processing. Meanwhile, the ROM 23 may be configured incapable of rewriting.

The RAM 25 is a main memory of the CPU 21. The RAM 25 is used to store necessary data when the CPU 21 executes the control program 27*a* as described later.

The scanning unit 40 executes the scanner function to read the image data from the document as described above. The image data read by the scanning unit 40 is converted to an application data format by the CPU 21 and stored in the HDD 27 and the like. The CPU 21 can transmit the image data stored in the HDD 27 and the like to the PCs 71, 73, for example.

[Timing to Start Applying Charging Bias Voltage and Developing Bias Voltage]

Figure 5:
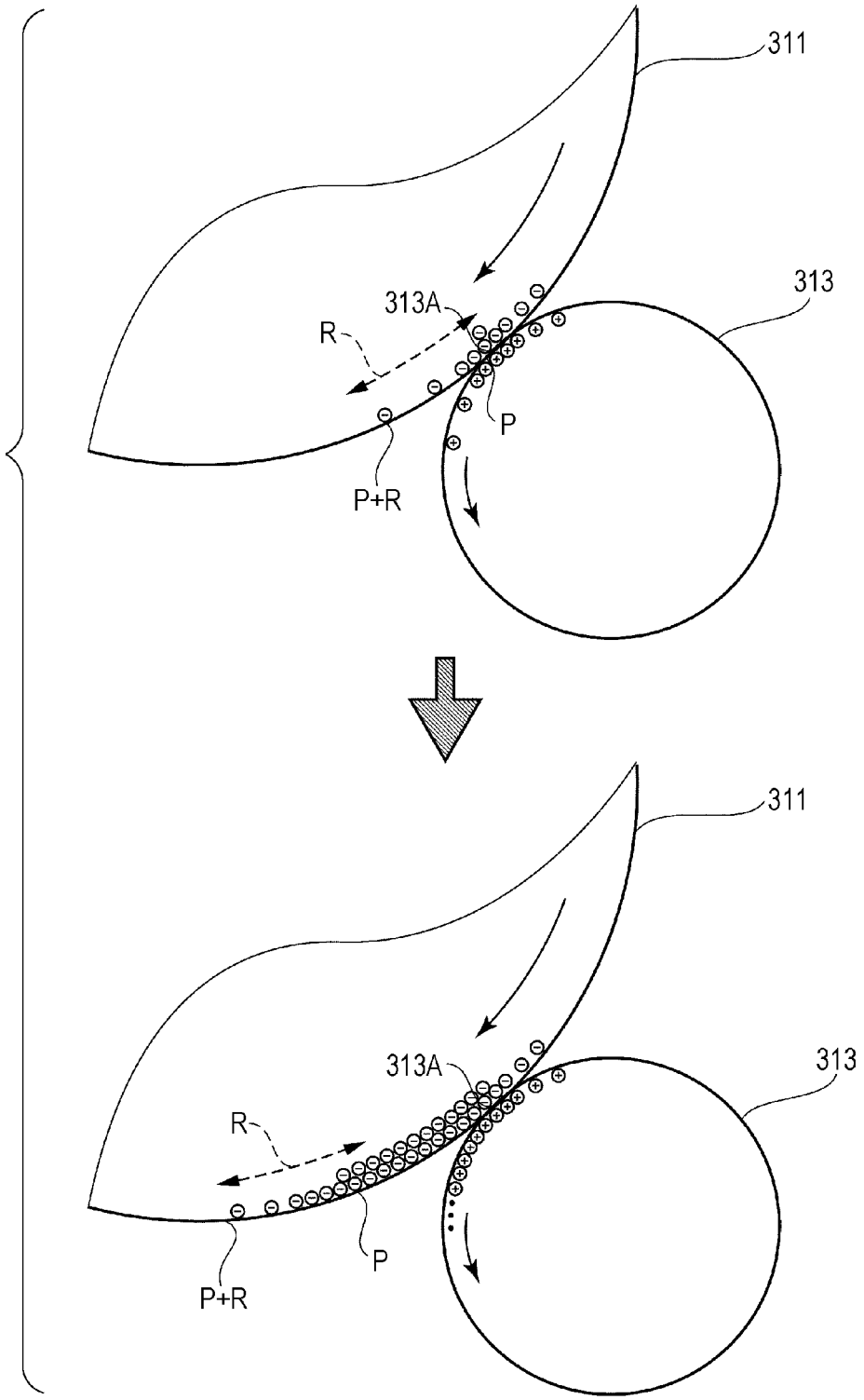
FIG. 5 is an explanatory view for charging operation by a charging roller on a surface of a photoreceptor.

FIG. 5 is an explanatory view for charging operation by the charging roller 313 on the surface of the photoreceptor 311.

In FIG. 5, arrows indicated on the charging roller 313 and the photoreceptor 311 represent rotation directions of the charging roller 313 and the photoreceptor 311, respectively. An upper view in FIG. 5 illustrates a state in which application of the charging bias voltage is started, and a lower view illustrates a state in which the charging roller 313 and the photoreceptor 311 are rotated by a small amount thereafter.

The charging roller 313 contacts the surface of the photoreceptor 311 at a charging nip 313A. When the charging bias voltage is applied to the charging roller 313, an area out of the surface of the photoreceptor 311 close to the charging roller 313 in a periphery of application start point P positioned at the charging nip 313A is charged. Then, while the charging bias voltage is applied, the charging roller 313 and the photoreceptor 311 are rotated, thereby charging an area located on a more rear side of the rotation direction of the photoreceptor 311 than the application start point P.

Here, the region located closer to the charging nip 313A is located closer to the charging roller 313, and has a larger charging amount. Therefore, in an area located on a more front side of the rotation direction of the photoreceptor 311 than the application start point P, the charging amount is gradually increased toward the application start point P. Furthermore, the larger the absolute value of the charging bias voltage is, the larger the charging amount is. As illustrated in an arrow R in FIG. 5, the charging amount is varied by a value of the charging bias voltage in the area located on the more front side of the rotation direction of the photoreceptor 311 than the application start point P (area located on the rear side of the rotation direction from a discharge start position P+R).

In the present embodiment, the controller 20 controls the timing to start applying the developing bias voltage relative to the timing to start applying the charging bias voltage in accordance with the value of the charging bias voltage applied during image forming. With this configuration, even in the case where the values of the charging bias voltage are different and the charging range on the surface of the photoreceptor 311 and the potential on the surface are different, application of the developing bias voltage is started at appropriate timing.

Figure 6:
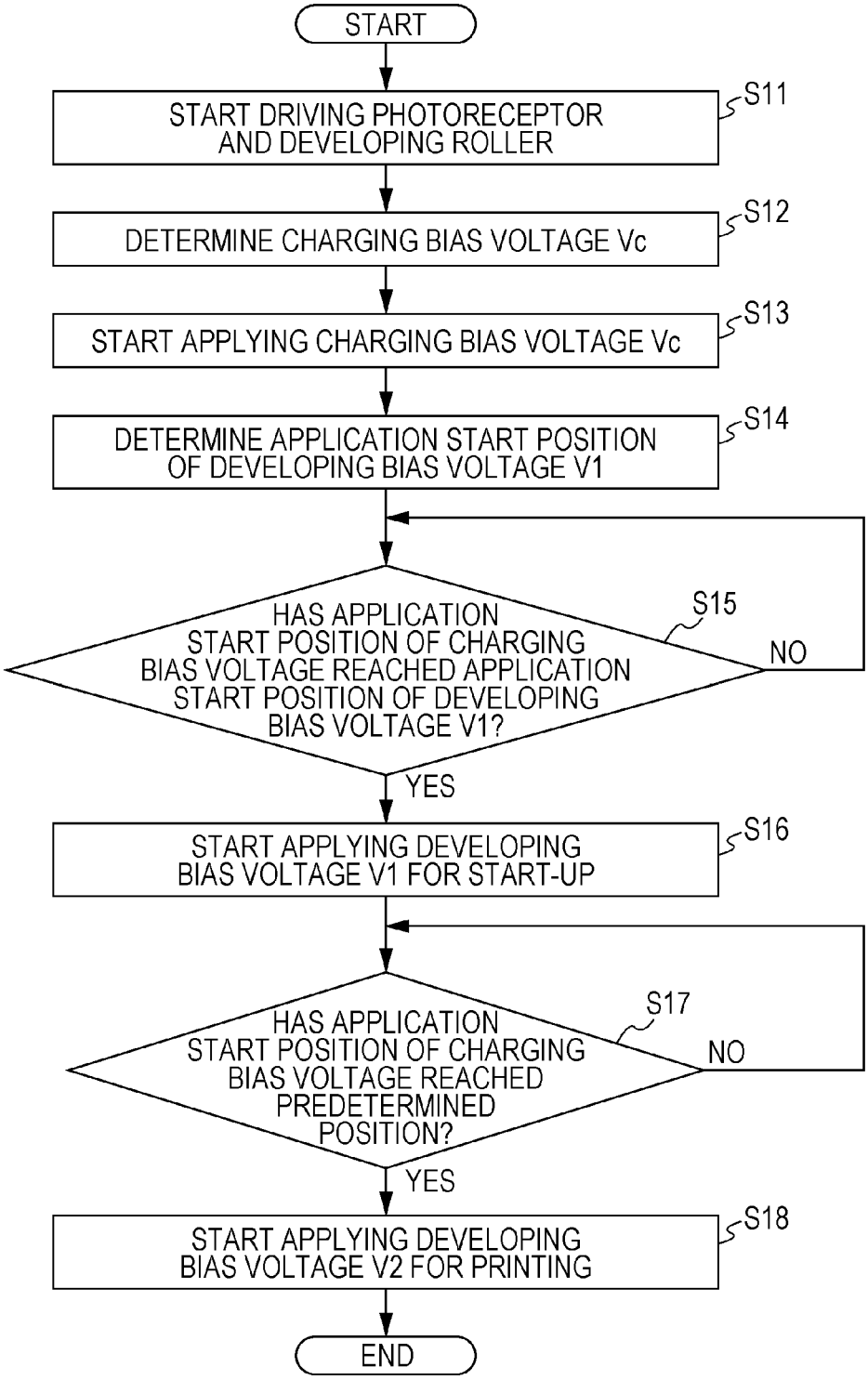
FIG. 6 is a flowchart illustrating a flow of control operation performed by a controller at the time of image forming.

FIG. 6 is a flowchart illustrating a flow of control operation performed by the controller 20 at the time of image forming.

In FIG. 6, control operation related to the timing to start applying the charging bias voltage and the developing bias voltage relative to each of the print heads 310 is illustrated. This control operation is performed every time a print job is started.

In Step S11, the controller 20 starts driving the photoreceptor 311, the charging roller 313, the developing roller 315, and the like. These rollers and the like are rotated at a constant speed. When rotation is stabilized, the processing proceeds to Step S12.

In Step S12, the controller 20 determines charging bias voltage Vc to be applied to the charging roller 313 at the time of image forming. As described later, the charging bias voltage Vc is determined in accordance with developing bias voltage V2 for printing to be applied to the developing roller 315 at the time of image forming. As described later, the developing bias voltage V2 is set by the controller 20 in accordance with a toner concentration, environment information around the image forming device 1, and the like.

In Step S13, the controller 20 starts applying the charging bias voltage Vc. Charging is applied on the surface of the photoreceptor 311 around the application start point P where application of the charging bias voltage Vc is started.

In Step S14, the controller 20 determines an application start position of developing bias voltage V1 for start-up (hereinafter may be referred to as a first application position). More specifically, the controller 20 determines the timing to start applying the developing bias voltage V1 relative to the timing to start applying the charging bias voltage Vc (interval from the timing to start applying the charging bias voltage to the timing to start applying the developing bias voltage).

In Step S15, the controller 20 waits until the application start point P reaches the first application position. After reaching, the processing proceeds to Step S16.

In Step S16, the controller 20 starts applying the developing bias voltage V1 for start-up.

In Step S17, the controller 20 waits until the application start point P reaches a predetermined position (hereinafter may be referred to as a second application position). After reaching, the processing proceeds to Step S18.

In Step S18, the controller 20 starts applying the developing bias voltage V2 for printing. Consequently, development of an electrostatic latent image is started on the photoreceptor 311.

Note that the developing bias voltage is applied so as to stepwisely increase. In the present embodiment, the developing bias voltage is applied in two steps. More specifically, when the application start point P reaches the first application position, application of the developing bias voltage V1 for start-up is started. After that, when the application start point P reaches the second application position, the absolute value of the voltage is increased from the developing bias voltage V1, and the developing bias voltage V2 for printing is applied. Meanwhile, the developing bias voltage may also be applied so as to gradually increase in more than three steps and to be close to the developing bias voltage V2 for printing.

Figure 7:
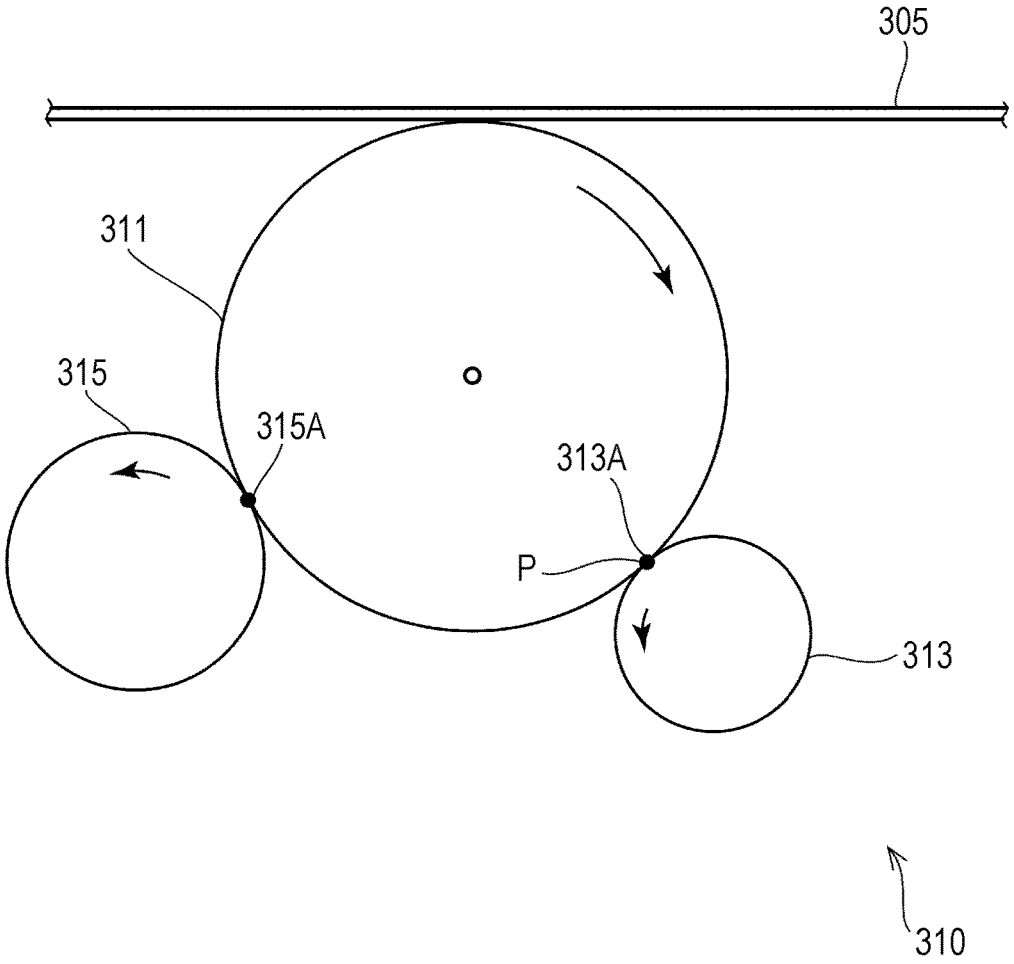
FIG. 7 is a first explanatory view for charging and developing operation at the time of image forming.

FIG. 7 is a first explanatory view for charging and developing operation at the time of image forming.

In FIG. 7, a state at the time of starting image forming in the print head 310 is illustrated. The photoreceptor 311, the charging roller 313, and the developing roller 315 are rotated at a constant speed.

When the controller 20 starts applying the charging bias voltage Vc, the surface of the photoreceptor 311 is charged. At this point, charging is applied on the surface around the application start point P located at the charging nip 313A when application of the charging bias voltage Vc is started. Meanwhile, an absolute value of the potential on the surface of the photoreceptor 311 is increased by discharge caused by a difference between the potential on the surface of the photoreceptor 311 and the charging bias voltage Vc. Therefore, the absolute value of the photoreceptor surface potential is always smaller than an absolute value of the charging bias voltage Vc. A relation between the charging bias voltage and the photoreceptor surface potential is varied by a discharging state. For example, the absolute value of the photoreceptor surface potential is smaller than the absolute value of the charging bias voltage by about 600 V.

Figure 8:
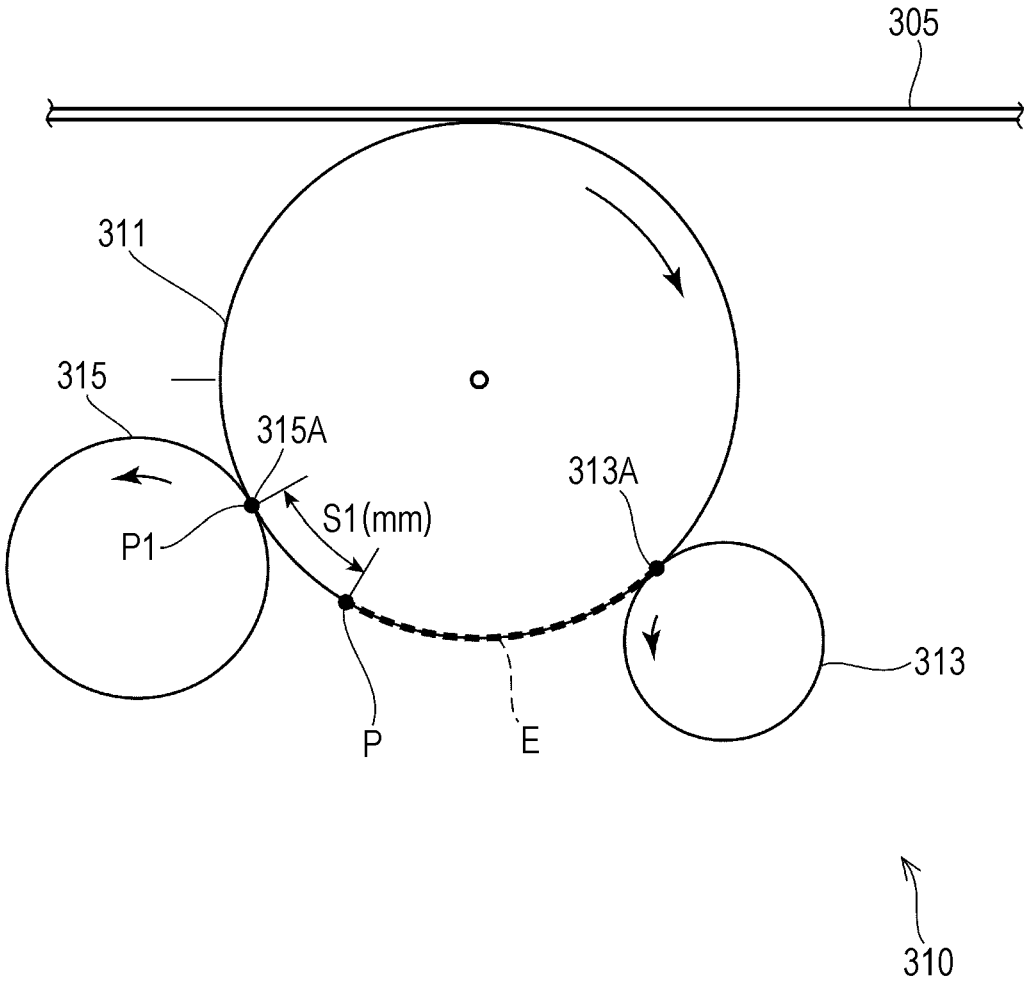
FIG. 8 is a second explanatory view for charging and developing operation at the time of image forming.

FIG. 8 is a second explanatory view for charging and developing operation at the time of image forming.

Figure 9:
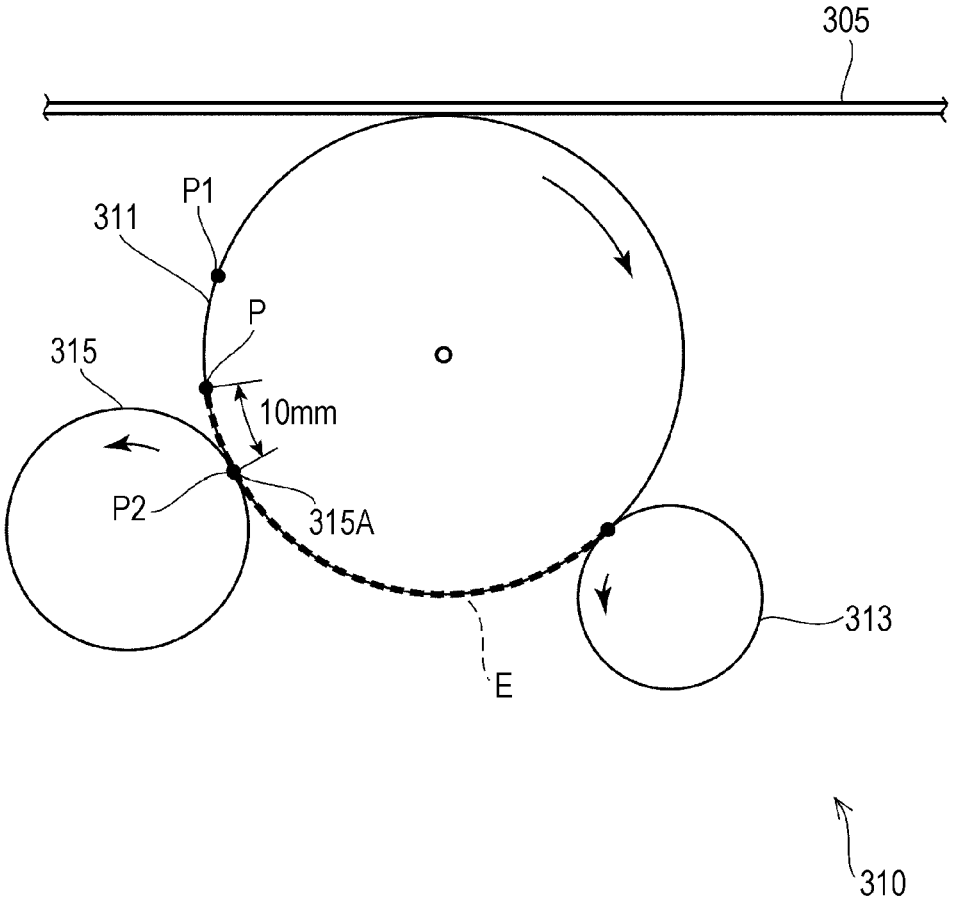
FIG. 9 is a third explanatory view for charging and developing operation at the time of image forming.

In FIGS. 8 and 9, a charged area E on the surface of the photoreceptor 311 is indicated by a dotted line. After application of the charging bias voltage Vc is started, the application start point P approaches a developing nip 315A located between the photoreceptor 311 and the developing roller 315 due to continuous rotation of the photoreceptor 311. In FIG. 8, a state in which the application start point P has reached the first application position is illustrated.

In the present embodiment, the first application position is a position located on a rear side of the developing nip 315A (upstream side of the rotation direction of the photoreceptor 311) and distant from the developing nip 315A by S1 millimeters. The distance S1 is determined as described below.

When the application start point P thus reaches the first application position, application of the developing bias voltage V1 for start-up is started. More specifically, application of the developing bias voltage V1 for start-up is started at the timing when a position P1 located distant in a front direction from the application start point P by the distance S1 reaches the developing nip 315A on the surface of the photoreceptor 311.

FIG. 9 is a third explanatory view for charging and developing operation at the time of image forming.

In FIG. 9, a state in which the application start point P has reached the second application position after application of the developing bias voltage V1 for start-up is started is illustrated.

In the present embodiment, the second application position is a position located on a front side of the developing nip 315A (downstream side of the rotation direction of the photoreceptor 311) and distant from the developing nip 315A by 10 millimeters. The distance is a position preliminarily set. Note that the distance from the developing nip 315A to the second application position is not limited to 10 millimeters. Furthermore, the distance may be suitably changed by the controller 20 in accordance with various kinds of predetermined rules.

When the application start point P thus reaches the second application position, application of the developing bias voltage V2 for printing is started. More specifically, application of the developing bias voltage V2 for printing is started at the timing when a position P2 distant in the rear direction from the application start point P by 10 millimeters reaches the developing nip 315A on the surface of the photoreceptor 311. The second application position is set such that the electrostatic latent image is surely and properly developed by starting application of the developing bias voltage V2 from the developing nip 315A when the application start point P reaches the second application position.

Figure 10:
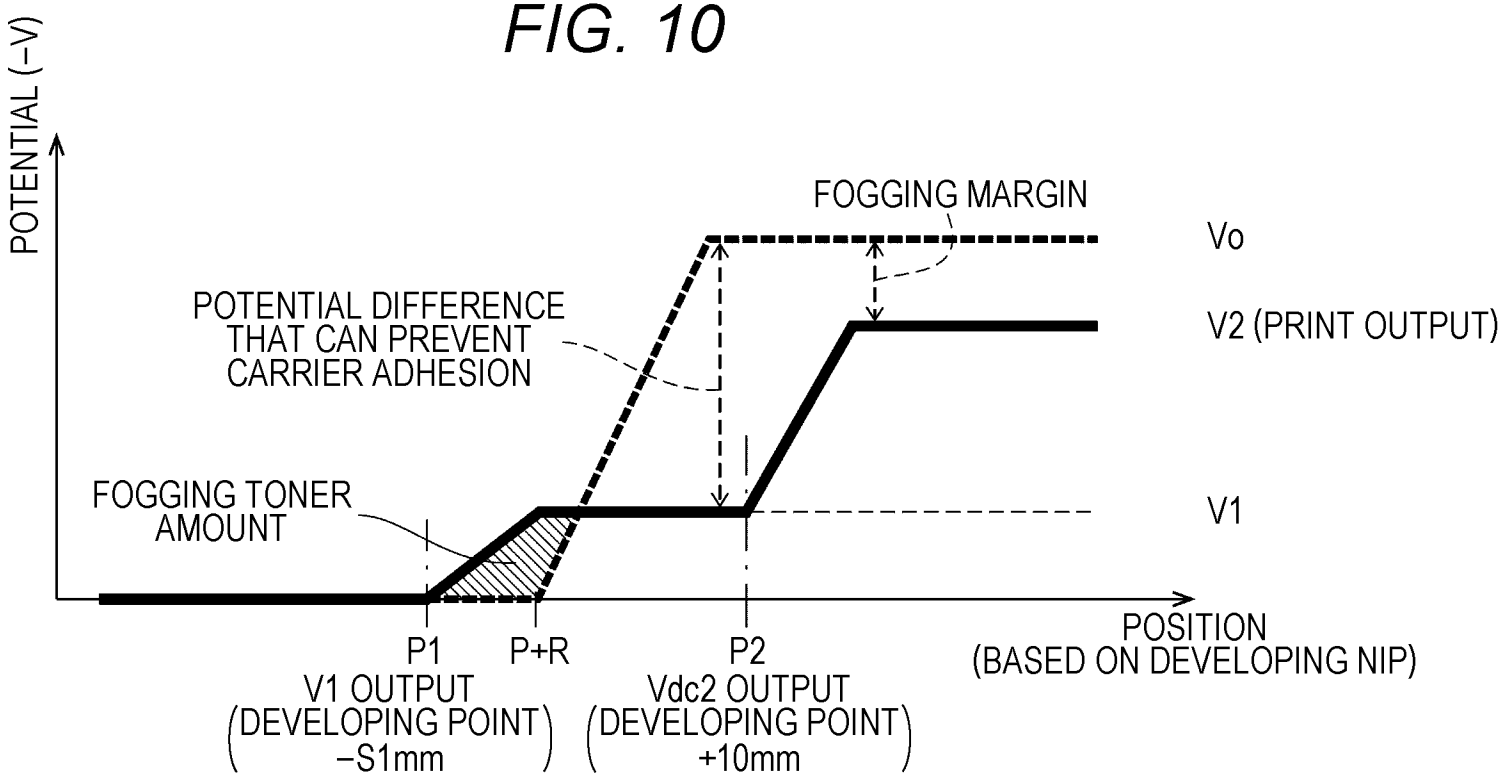
FIG. 10 is an explanatory graph for charging and developing operation at the time of image forming.

FIG. 10 is an explanatory graph for charging and developing operation at the time of image forming.

In FIG. 10, a vertical axis represents the respective absolute values of the photoreceptor surface potential and the developing bias voltage. According to the present embodiment, negative voltage is applied. Additionally, a horizontal axis represents a position on the surface of the photoreceptor 311, in which a right side indicates a rear side thereof (downstream side of the rotation direction). The potential on the surface at the respective positions of the photoreceptor 311 is indicated by a dotted line, and the developing bias voltage is indicated by a solid line.

It takes some time for the charging bias voltage Vc to reach a target value after starting application thereof. The absolute value of the charging bias voltage Vc is increased from zero at the application start point P. When discharging is started, the surface potential of the photoreceptor 311 gradually starts to be increased within a range of a discharge start point P+R when discharge occurs around the charging nip 313A as illustrated in FIG. 5. Therefore, when application of the charging bias voltage Vc is started, the photoreceptor surface potential is slowly increased from the discharge start point P+R on the graph. The photoreceptor surface potential reaches the target value Vo on the downstream side of the rotation direction of the photoreceptor 311.

Application of the developing bias voltage V1 for start-up is started when the application start point P is located before the developing nip 315A by S1 millimeters. More specifically, the developing bias voltage starts to be increased from zero at the position P1. Meanwhile, since it takes some time for the developing bias voltage to reach the target value of voltage V1 after application is started, the developing bias voltage is also slowly increased on the graph. When application is started at the position P1, the developing bias voltage is increased up to the voltage V1 in the rear side position.

Application of the developing bias voltage V2 for printing is started when the application start point P is located on a rear side from the developing nip 315A by 10 millimeters. More specifically, the developing bias voltage starts to be increased from the voltage V1 at the position P2. When application of the developing bias voltage (boosting) is started at the position P2, the developing bias voltage reaches V2 for print output at a position on the rear side, and the electrostatic latent image can be developed.

The controller 20 determines the developing bias voltage V2 to be applied during image forming such that a toner adhesion amount on the photoreceptor 311 becomes a predetermined adhesion amount. More specifically, the controller 20 determines the target value Vo of the surface potential of the photoreceptor 311 during image forming. For example, the controller 20 reads the toner adhesion amount on the photoreceptor 311 by using a reflective optical sensor or the like, and determines the target value based on this read result such that the developing bias voltage V2 has the predetermined adhesion amount (for example, about 5 $g/m^2$). Therefore, the developing bias voltage V2 may be varied in accordance with various conditions at the time of image forming.

Furthermore, the charging bias voltage Vc is generally set such that the absolute value becomes relatively large in the following situations. More specifically, there may be a situation in which the photoreceptor is new and has a large film thickness, and therefore, the photoreceptor 311 has small capacitance and hardly can perform discharging. Furthermore, there may be a situation in which discharging can be hardly performed due to an environment of low temperature and low humidity. Moreover, there may be a situation in which atmospheric pressure is high and discharging can be hardly performed. The charging bias voltage Vc is adjusted in accordance with such various kinds of conditions.

The controller 20 sets the photoreceptor surface potential such that the absolute value of the developing bias voltage V2 for printing becomes smaller than the absolute value of the photoreceptor surface potential by a predetermined potential difference (for example, about 100 V) (fogging margin). This surely prevents occurrence of a toner fogging phenomenon in which the toner adheres to a region other than an electrostatic latent image.

[Description for Determining Distance S1]

Here, the toner fogging phenomenon mainly occurs in a section where the developing bias voltage is larger than the photoreceptor surface potential. Additionally, in this section, an area surrounded by the developing bias voltage and the photoreceptor surface potential (the area indicated by diagonal lines in FIG. 10) has the area corresponding to an amount of toner adhesion occurrence. In the present embodiment, when a print job is started, the controller 20 sets the interval from the timing to start applying the charging bias voltage Vc to the timing to start applying the developing bias voltage V1 in accordance with the absolute value of the charging bias voltage Vc in order to prevent carrier adhesion to the photoreceptor 311 while suppressing the toner consumption. More specifically, the controller 20 determines the distance S1 in accordance with the absolute value of the charging bias voltage Vc, and then determines the position P1 to start applying the developing bias voltage V1 for start-up.

Figure 11:
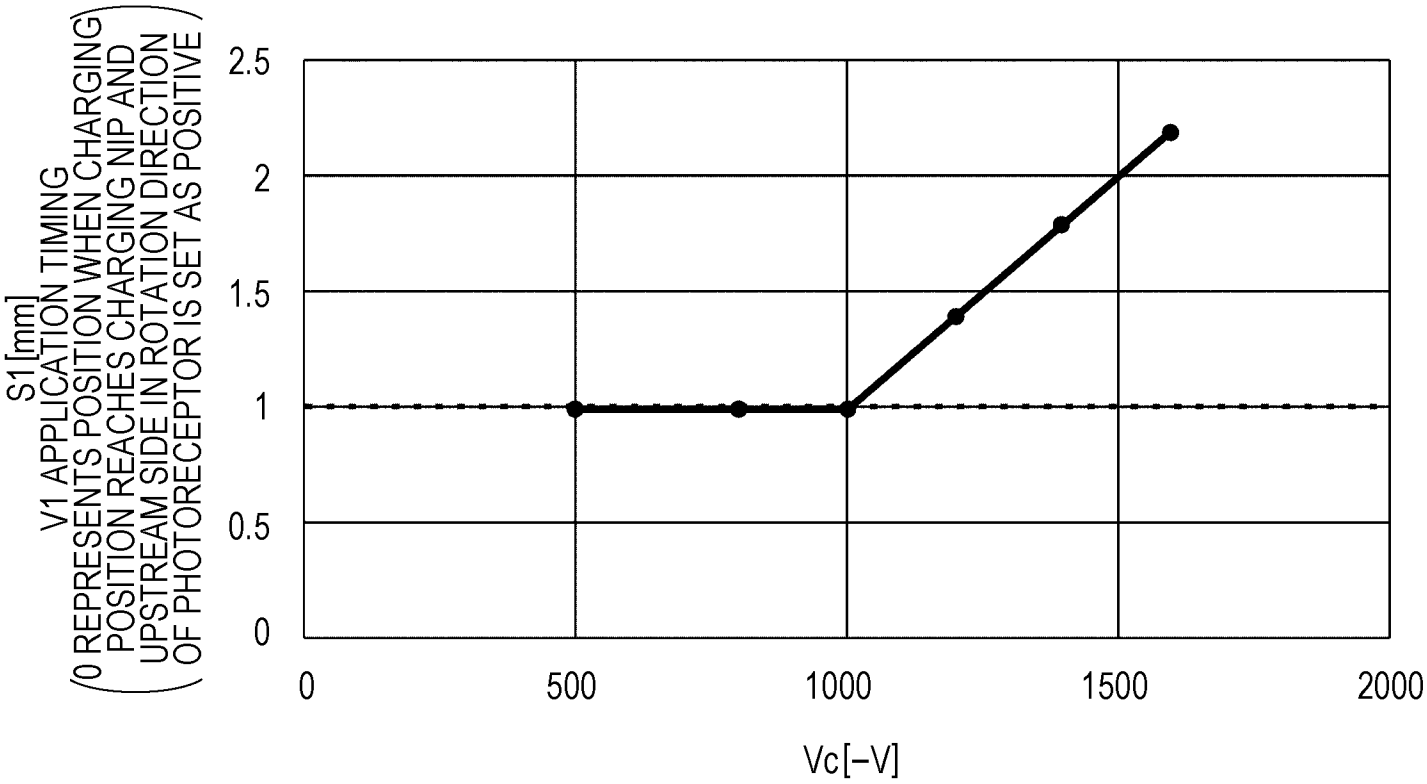
FIG. 11 is an explanatory graph for determining a position to start applying developing bias voltage.

FIG. 11 is an explanatory graph for determining a position to start application of developing bias voltage V1.

As illustrated in FIG. 11, the distance S1 indicated in a vertical axis is set in accordance with the absolute value of the charging bias voltage Vc indicated in a horizontal axis. In the present embodiment, the larger the absolute value of the charging bias voltage Vc is, the shorter the interval from the timing to start applying the charging bias voltage Vc to the timing to start applying the developing bias voltage V1 is. In other words, the larger the absolute value of the charging bias voltage Vc is, the larger the distance S1 is. Furthermore, the smaller the absolute value of the charging bias voltage Vc is, the longer the interval from the timing to start applying charging bias voltage Vc to timing to start applying the developing bias voltage V1 is. In other words, the smaller the absolute value of the charging bias voltage Vc is, the smaller the distance S1 is.

Here, according to the present embodiment, a lower limit value of the distance S1 (an upper limit value of the above-described interval) is preliminarily set. For example, the lower limit value of the distance S1 is set to 1 millimeter.

The controller 20 performs controls such that the distance S1 becomes the lower limit value when the absolute value of the charging bias voltage Vc is smaller than a value corresponding to the lower limit value of the distance S1. Consequently, application of the developing bias voltage V1 is constantly started at the timing before the application start point P reaches a place one millimeter before the developing nip 315A.

The distance S1 is calculated by a formula below. Here, So represents a correction value, for example, −1 millimeter. K represents a correction coefficient of Vc, for example, −0.002. Vc represents the charging bias voltage applied during image forming, and the unit is volt. As for these offset value, constant, etc., appropriate values may be obtained through a test and the like from time to time. Meanwhile, in the present embodiment, Vc represents negative bias voltage.

$$S1=So+K\times Vc \text{ (where } S1=1 \text{ mm in the case of } S1<1 \text{ mm)}$$

[Description for Determining Developing Bias Voltage V1 for Start-Up]

As described above, after applying the developing bias voltage V1 for start-up, the developing bias voltage is kept at the developing bias voltage V1 until the position P2 on the photoreceptor 311 reaches the developing nip 315A. The developing bias voltage V1 is set such that a difference between the photoreceptor surface potential and the developing bias voltage V1 can surely have a potential difference that can prevent carrier adhesion. Even when photoreceptor surface potential is increased and reaches the target value at the time of image forming, carrier adhesion to the photoreceptor 311 from the developing roller 315 is prevented from occurring. In other words, the developing bias voltage V1 for start-up is set to a value offset by a predetermined amount relative to the target value Vo of the surface potential of the photoreceptor 311 during image forming (corresponding to the charging bias voltage Vc at the time of image forming).

Figure 12:
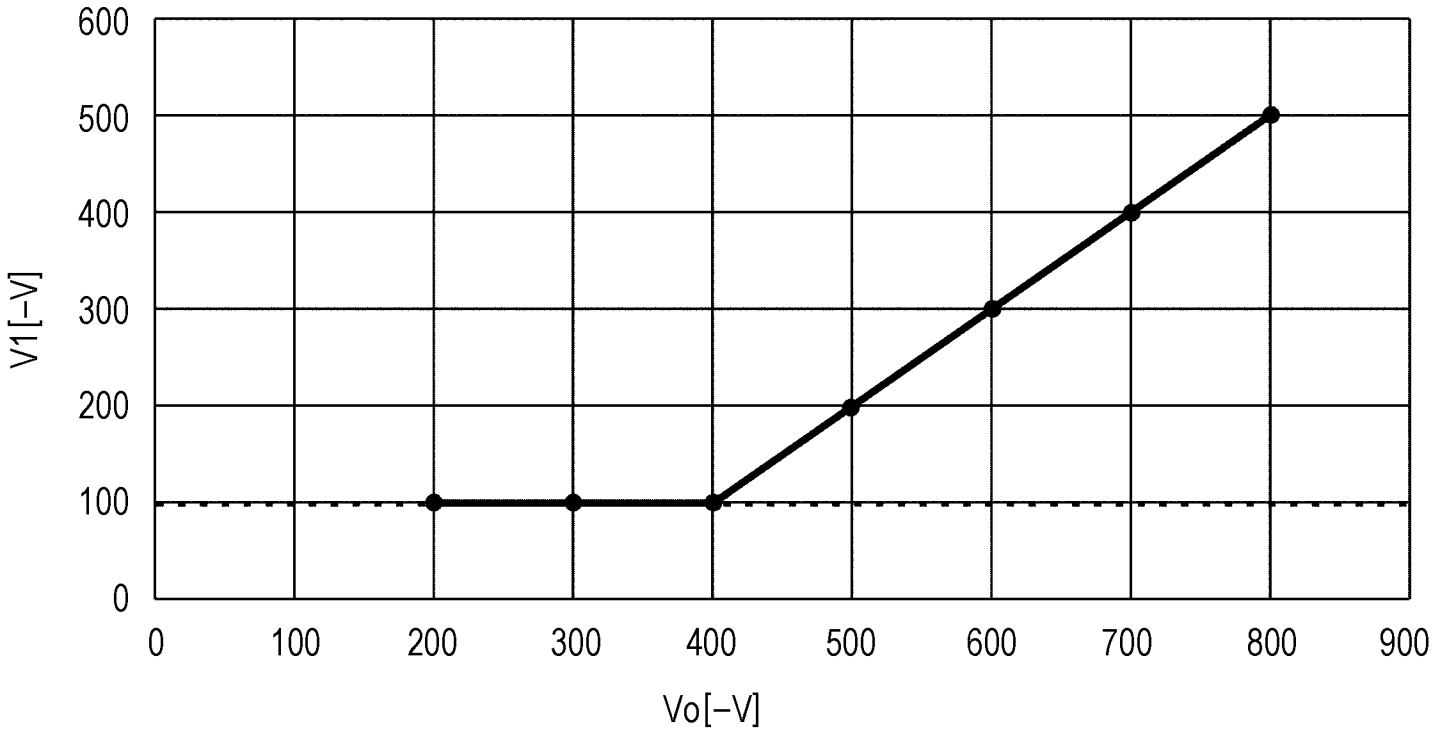
FIG. 12 is an explanatory graph for determining developing bias voltage for start-up.

FIG. 12 is an explanatory graph for determining the developing bias voltage V1 for start-up.

As illustrated in FIG. 12, the developing bias voltage V1 indicated in a vertical axis is set to the value offset by the predetermined amount relative to the photoreceptor surface potential indicated in a horizontal axis. More specifically, the developing bias voltage V1 is set such that the absolute value is reduced by 300 V relative the photoreceptor surface potential.

Here, in the present embodiment, the lower limit value of the absolute value of the developing bias voltage V1 is preliminarily set. For example, the lower limit value of the absolute value of the developing bias voltage V1 is set to 100 V, for example. The controller 20 performs control such that the absolute value of the developing bias voltage V1 becomes the lower limit value when the absolute value of the photoreceptor surface potential is smaller than the value corresponding to the lower limit value of the developing bias voltage V1. Consequently, the absolute value of the developing bias voltage V1 is kept constantly at 100 V or more.

The developing bias voltage V1 is calculated by a formula below. Here, Vo represents the target value of the surface potential of the photoreceptor 311, and the unit is volt. V1offset represents a predetermined offset correction value, for example, 300 V. As for these offset value, constant, etc., appropriate values may be obtained through a test and the like from time to time. Meanwhile, in the present embodiment, Vo and V1 are negative voltage.

$$V1=Vo\ V1\text{offset (where } V1=-100\ [V] \text{ in the case of } V1>-100[V]$$

Thus, in the present embodiment, the controller 20 determines first step bias voltage V1 for start-up of the developing bias voltage in accordance with the target value Vo of the surface potential of the photoreceptor 311. Therefore, carrier adhesion can be surely prevented.

[Effects of Embodiment]

As described above, in the present embodiment, the timing to start applying the developing bias voltage V1 relative to the timing to start applying the charging bias voltage Vc is adjusted in accordance with the value of the charging bias voltage Vc. The timing to start applying the developing bias voltage V1 can be set late within a range not causing carrier adhesion. Therefore, carrier adhesion can be prevented while the toner consumption amount is suppressed in various cases in which values of the charging bias voltage Vc are different. To achieve such control, hardware having an expensive structure is not needed, and manufacturing cost for the image forming device can be kept low.

In the roller charging system in which direct current charging bias voltage is applied, it is found that a discharging area expands substantially in proportion to the value of the charging bias voltage. Therefore, when control in accordance with the value of the charging bias voltage is performed in the image forming device thus configured like the present embodiment, the above-described effects can be more significantly obtained.

Furthermore, the interval from the timing to start applying the charging bias voltage Vc to the timing to start applying the developing bias voltage V1 has an upper limit. More specifically, since the lower limit value is set for the distance S1, the distance S1 can be prevented from being set too short (on the negative side) even in the case where the charging bias voltage Vc is set extremely low. Therefore, occurrence of carrier adhesion can be surely prevented.

OTHERS

Instead of the charging roller, a charging unit of a needle electrode system or a wire charge system which charges the surface of the photoreceptor by discharging may be used as well. In this case also, the similar effects can be obtained by controlling the timing to start applying the developing bias voltage relative to the timing to start applying the charging bias voltage in the same manner as above.

The developing bias voltage and the charging bias voltage may utilize AC voltage as well.

Meanwhile, depending on the configuration of the image forming device, there may be a case where the absolute value of the charging bias voltage is changed during image forming. In this case, for example, the interval from the timing to start applying charging bias voltage to the timing to start applying the developing bias voltage may be set based on a maximum absolute value of the charging bias voltage during image forming. More specifically, control may be performed such that the larger the maximum absolute value of the charging bias voltage during image forming is, the shorter the interval becomes, and also control may be performed such that the smaller the maximum absolute value of the charging bias voltage during image forming is, the longer the interval becomes. Consequently, carrier adhesion can be surely prevented while achieving an effect of reducing the toner consumption amount.

The developing bias voltage for start-up applied in the first step may be a value preliminarily set.

A printer unit is not limited to the tandem system using the intermediate transfer belt as described above. The printer unit may be a so-called 4-cycle system using an intermediate transfer belt, or may have a configuration in which a toner image is directly transferred from a photoreceptor to a paper without using an intermediate transfer belt. Furthermore, the printer unit may be formed to be capable of forming only a monochrome image.

In an image forming device capable of forming a color image and including a photoreceptor for each color, the above-described control may be independently performed per color, or the above-described control may not necessarily be performed for part of a plurality of colors.

Furthermore, the image forming device may be any one of a monochrome/color copy machine, a printer, a facsimile machine, a combined machine thereof (MFP), and the like.

Moreover, the processing in the above-described embodiment may be performed by software or by using a hardware circuit.

Additionally, a program to execute the processing in the above-described embodiment can be provided, too. The program may be provided to a user by recording the program in recording media such as a CD-ROM, a flexible disk, a hard disk, a ROM, a RAM, and a memory card. Furthermore, the program may be downloaded in a device via a communication line such as the Internet. The processing described in the above flowchart is executed by a CPU and the like in accordance with the program.

Although the present invention has been described and illustrated in detail, it is clearly understood that the same is by way of illustrated and example only and is not to be taken by way of limitation, the scope of the present invention being interpreted not by terms of the above description but by terms of the appended claims, and including equivalents of the claims and all changes falling within the scope of the claims.

What is claimed is:

1. An image forming device comprising:

a charging unit configured to apply charging bias voltage to a charging member and charge a surface of an image carrying body;

an exposure unit configured to expose the surface of the image carrying body charged by the charging unit to attenuate potential, and form an electrostatic latent image on the image carrying body;

a developing unit of a two-component development system configured to apply, to a developer carrying body, developing bias voltage having homopolarity with polarity of the charging bias voltage, and develop the electrostatic latent image; and a control unit configured to control timing to start applying the developing bias voltage relative to timing to start applying the charging bias voltage in accordance with a value of the charging bias voltage applied during image forming, wherein the control unit performs control such that the larger an absolute value of the charging bias voltage is, the shorter an interval from timing to start applying the charging bias voltage to timing to start applying the developing bias voltage becomes, and performs control such that the smaller the absolute value of the charging bias voltage is, the longer the interval becomes.

2. The image forming device according to claim 1, wherein an upper limit value of the interval is preliminarily set, and the control unit performs control such that the interval becomes the upper limit value when the absolute value of the charging bias voltage is smaller than a value corresponding to the upper limit value.

3. The image forming device according to claim 1, further comprising a target value determining unit configured to determine a target value of surface potential of the image carrying body during image forming based on a target value of the developing bias voltage applied during image forming, wherein the charging unit determines the charging bias voltage based on the target value of surface potential determined by the target value determining unit.

4. The image forming device according to claim 1, wherein the charging unit charges the surface of the image carrying body by a roller charging system.

5. The image forming device according to claim 1, wherein the control unit performs control such that the larger a maximum absolute value of the charging bias voltage during image forming is, the shorter the interval becomes, and the control unit performs control such that the smaller the maximum absolute value of the charging bias voltage during image forming is, the longer the interval becomes.

6. The image forming device according to claim 1, wherein the charging bias voltage is direct current bias voltage.

7. The image forming device according to claim 1, wherein the developing unit applies the developing bias voltage in a manner increasing the absolute value of the developing bias voltage stepwisely, and a value of the developing bias voltage to be applied in a first step after starting applying the developing bias voltage is a value offset by a predetermined amount relative to a target value of surface potential of the image carrying body during image forming.

8. A control method for an image forming device comprising:

a charging unit configured to apply charging bias voltage to a charging member and charge a surface of an image carrying body;

an exposure unit configured to expose the surface of the image carrying body charged by the charging unit to attenuate potential, and form an electrostatic latent image on the image carrying body; and a developing unit of a two-component development system configured to apply, to a developer carrying body, developing bias voltage having homopolarity with polarity of the charging bias voltage, and develop the electrostatic latent image, the control method comprising:

a determining step of determining a value of the charging bias voltage to be applied during image forming; and a controlling step of controlling timing to start applying the developing bias voltage relative to timing to start applying the charging bias voltage in accordance with the value of the charging bias voltage determined in the determining step, wherein, in the controlling step, control is performed such that the larger an absolute value of the charging bias voltage is, the shorter an interval from timing to start applying the charging bias voltage to timing to start applying the developing bias voltage becomes, and control is performed such that the smaller the absolute value of the charging bias voltage is, the longer the interval becomes.

9. The control method according to claim 8, wherein an upper limit value of the interval is preliminarily set, and in the controlling step, control is performed such that the interval becomes the upper limit value when the absolute value of the charging bias voltage is smaller than a value corresponding to the upper limit value.

10. A non-transitory recording medium storing a computer readable control program for an image forming device comprising:

a charging unit configured to apply charging bias voltage to a charging member and charge a surface of an image carrying body;

an exposure unit configured to expose the surface of the image carrying body charged by the charging unit to attenuate potential, and form an electrostatic latent image on the image carrying body; and a developing unit of a two-component development system configured to apply, to a developer carrying body, developing bias voltage having homopolarity with polarity of the charging bias voltage, and develop the electrostatic latent image, the control program causing a computer to execute:

a determining step of determining a value of the charging bias voltage applied during image forming; and a controlling step of controlling timing to start applying the developing bias voltage relative to timing to start applying the charging bias voltage in accordance with the value of the charging bias voltage determined in the determining step, wherein, in the controlling step, control is performed such that the larger an absolute value of the charging bias voltage is, the shorter an interval from timing to start applying the charging bias voltage to timing to start applying the developing bias voltage becomes, and control is performed such that the smaller the absolute value of the charging bias voltage is, the longer the interval becomes.

11. The non-transitory recording medium according to claim 10, wherein an upper limit value of the interval is preliminarily set, and in the controlling step, control is performed such that the interval becomes the upper limit value when the absolute value of the charging bias voltage is smaller than a value corresponding to the upper limit value.

* * * * *